US008065949B1

(12) United States Patent
Molinari

(10) Patent No.: US 8,065,949 B1
(45) Date of Patent: Nov. 29, 2011

(54) GAS-OPERATED FIREARM

(75) Inventor: Gian Mario Molinari, Castelmella (IT)

(73) Assignee: Remington Arms Company, Inc., Madison, NC (US)

( * ) Notice: Subject to any disclaimer, the term of this patent is extended or adjusted under 35 U.S.C. 154(b) by 904 days.

(21) Appl. No.: 11/753,344

(22) Filed: May 24, 2007

(30) Foreign Application Priority Data

May 24, 2006 (IT) ..... MI2006A1022

(51) Int. Cl.
*F41A 5/28* (2006.01)

(52) U.S. Cl. ..... 89/193

(58) Field of Classification Search ..... 89/191.01, 89/191.02, 192, 193
See application file for complete search history.

(56) References Cited

U.S. PATENT DOCUMENTS 785,974 A * 3/1905 McClean ..... 89/193
966,995 A * 8/1910 Brown ..... 89/193
1,003,632 A * 9/1911 McClean ..... 89/193
1,431,059 A * 10/1922 Sutter ..... 89/193
1,469,918 A * 10/1923 De Maine ..... 89/193
1,521,730 A * 1/1925 Swebilius ..... 89/191.01
1,996,124 A 4/1935 Rowley
2,093,706 A 9/1937 Browning
2,186,582 A 1/1940 Gebauer
2,554,618 A 5/1951 Dixon
2,582,989 A * 1/1952 Harvey ..... 89/193
2,637,247 A 5/1953 Hester
2,777,366 A * 1/1957 Cook ..... 89/193
2,887,013 A 5/1959 Marsh
2,918,847 A 12/1959 Barr
2,987,968 A 6/1961 Janson
3,125,930 A * 3/1964 Gilbert ..... 89/191.01
3,166,983 A 1/1965 Lizza
3,306,168 A 2/1967 Blumrick
3,443,477 A 5/1969 Kaempf
3,444,641 A 5/1969 Ruger
3,568,564 A 3/1971 Badali
3,592,101 A 7/1971 Vartanian et al.
3,601,002 A 8/1971 Janson
3,675,534 A 7/1972 Beretta
3,680,434 A 8/1972 Muhlemann (Continued)

FOREIGN PATENT DOCUMENTS

DE 41 36 665 A1 5/1993

(Continued)

OTHER PUBLICATIONS

International Search Report (ISR) for related Application No. PCT/US2007/012364, mailed Oct. 27, 2008.

(Continued)

*Primary Examiner* — Michael Carone
*Assistant Examiner* — Jonathan C Weber
(74) *Attorney, Agent, or Firm* — McGuireWoods, LLP

(57) ABSTRACT

A gas operating system for a firearm renders the firearm capable of firing a wide range of shot loads by passively or automatically compensating for different shot loads. The firearm includes a plurality of ports formed in the firearm barrel, and corresponding ports formed in a gas cylinder of the gas operating system. The ports tap gases generated during firing which are used to cycle the firearm. When firing different cartridge loads, differing combinations of the ports are selectively at least partially blocked or otherwise obstructed by the cartridge casing according to the size of the cartridge.

22 Claims, 8 Drawing Sheets

U.S. PATENT DOCUMENTS

| | | | |
|---|---|---|---|
| 3,707,110 | A | 12/1972 | Alday |
| 3,709,092 | A | 1/1973 | Tazome |
| 3,776,096 | A | 12/1973 | Donovan |
| 3,810,412 | A | 5/1974 | Zamacola |
| 3,945,296 | A | 3/1976 | Hyytinen |
| 3,988,964 | A | 11/1976 | Moore |
| 3,990,348 | A | 11/1976 | Vesamaa |
| 3,999,534 | A | 12/1976 | Chapin et al. |
| 4,014,247 | A | 3/1977 | Tollinger |
| 4,015,512 | A | 4/1977 | Feerick |
| 4,056,038 | A | 11/1977 | Rath |
| 4,058,922 | A | 11/1977 | Elbe et al. |
| 4,085,654 | A | 4/1978 | Panigoni |
| 4,102,242 | A | 7/1978 | Liedke |
| 4,109,558 | A | 8/1978 | Panigoni |
| 4,125,054 | A | 11/1978 | Jennie |
| 4,126,077 | A | 11/1978 | Quesnel |
| 4,178,832 | A | 12/1979 | Crowell |
| 4,373,423 | A | 2/1983 | Moore |
| 4,389,920 | A | 6/1983 | Dufour, Sr. |
| 4,395,838 | A | 8/1983 | Civolani |
| 4,409,883 | A | 10/1983 | Nyst |
| 4,414,880 | A | 11/1983 | Throner et al. |
| 4,475,438 | A | 10/1984 | Sullivan |
| 4,505,183 | A | 3/1985 | Grehl |
| 4,538,502 | A | 9/1985 | Benelli |
| 4,563,937 | A | 1/1986 | White |
| 4,599,934 | A | 7/1986 | Palmer |
| 4,604,942 | A | 8/1986 | Benelli |
| 4,702,146 | A | 10/1987 | Ikeda et al. |
| 4,709,617 | A | 12/1987 | Anderson |
| 4,765,224 | A | 8/1988 | Morris |
| 4,856,217 | A | 8/1989 | Benelli |
| 4,872,392 | A | 10/1989 | Powers et al. |
| 4,901,623 | A | 2/1990 | Lee |
| 5,157,210 | A | 10/1992 | Davis |
| 5,173,564 | A | 12/1992 | Hammond, Jr. |
| 5,218,163 | A | 6/1993 | Dabrowski |
| 5,272,956 | A | 12/1993 | Hudson |
| 5,274,939 | A | 1/1994 | Scaramucci et al. |
| 5,279,202 | A | 1/1994 | Bellardi et al. |
| 5,287,642 | A | 2/1994 | Scaramucci |
| 5,351,598 | A | 10/1994 | Schuetz |
| 5,404,790 | A | 4/1995 | Averbukh |
| 5,448,940 | A | 9/1995 | Schuetz et al. |
| 5,499,569 | A | 3/1996 | Schuetz |
| 5,520,019 | A | 5/1996 | Schuetz |
| 5,726,377 | A | 3/1998 | Harris et al. |
| 5,737,865 | A | 4/1998 | Brandl et al. |
| 5,767,434 | A | 6/1998 | Hirtl et al. |
| 5,824,943 | A | 10/1998 | Guhring et al. |
| 5,827,992 | A | 10/1998 | Harris et al. |
| 5,867,928 | A | 2/1999 | Plebani |
| 5,872,323 | A | 2/1999 | Norton et al. |
| 5,937,558 | A | 8/1999 | Gerard |
| 5,939,659 | A | 8/1999 | Dobbins |
| 5,959,234 | A | 9/1999 | Scaramucci |
| 5,983,549 | A | 11/1999 | Battaglia |
| 6,029,645 | A | 2/2000 | Wonisch et al. |
| 6,243,978 | B1 | 6/2001 | Vignaroli et al. |
| 6,347,569 | B1 | 2/2002 | Butler |
| 6,374,528 | B1 | 4/2002 | Davis et al. |
| 6,374,720 | B1 | 4/2002 | Tedde |
| 6,382,073 | B1 | 5/2002 | Beretta |
| 6,446,559 | B1 | 9/2002 | Vallender et al. |
| 6,508,160 | B2 | 1/2003 | Beretta |
| 6,564,691 | B2 | 5/2003 | Butler |
| 6,606,952 | B2 | 8/2003 | Vallender et al. |
| 6,619,592 | B2 | 9/2003 | Vignaroli |
| 6,662,485 | B2 | 12/2003 | Kay |
| 6,834,455 | B2 | 12/2004 | Burigana |
| 6,886,286 | B2 | 5/2005 | Dowding |
| 6,889,461 | B2 | 5/2005 | Vignaroli et al. |
| 6,971,202 | B2 | 12/2005 | Bender |
| 7,162,823 | B2 | 1/2007 | Schoppmann et al. |
| 7,252,138 | B2 | 8/2007 | Burkhalter et al. |
| 7,311,032 | B2 | 12/2007 | Murello |
| 7,343,844 | B2 | 3/2008 | Poff, Jr. |
| 7,448,307 | B1 | 11/2008 | Dafinov |
| 7,461,581 | B2 | 12/2008 | Leitner-Wise |
| 7,467,581 | B2 | 12/2008 | Botty |
| 2001/0054350 | A1 | 12/2001 | Beretta |
| 2002/0073832 | A1 | 6/2002 | Vignaroli et al. |
| 2002/0096042 | A1 | 7/2002 | Adkins |
| 2002/0139362 | A1 | 10/2002 | Shipachev et al. |
| 2005/0016374 | A1 | 1/2005 | Pescini |
| 2005/0223613 | A1 | 10/2005 | Bender |
| 2005/0235817 | A1 | 10/2005 | Murello |
| 2005/0257681 | A1 | 11/2005 | Keeney et al. |
| 2005/0268516 | A1 | 12/2005 | Nelson |
| 2006/0065112 | A1 | 3/2006 | Kuczynko et al. |
| 2007/0012169 | A1 | 1/2007 | Gussalli |

FOREIGN PATENT DOCUMENTS

| | | |
|---|---|---|
| EP | 0 789 217 | 1/1997 |
| EP | 1215464 | 6/2002 |
| EP | 1624275 | 2/2006 |
| FR | 2 686 152 | 7/1993 |
| GB | 214505 | 6/1923 |
| GB | 1405189 | 9/1975 |
| RU | 2279028 C1 | 6/2006 |

OTHER PUBLICATIONS

Written Opinion (WO) for related Application No. PCT/US2007/012364, mailed Oct. 27, 2008.

Notification of Transmittal of the International Search Report and the Written Opinion of the International Searching Authority, or the Declaration mailed Jul. 21, 2009 for PCT Application No. PCT/US2008/074601.

International Preliminary Report on Patentability mailed Mar. 2, 2010.

Notification of Transmittal of the International Search Report and the Written Opinion of the International Searching Authority, or the Declaration mailed Sep. 3, 2010 for PCT Application No. PCT/US2010/039526.

* cited by examiner

GAS-OPERATED FIREARM

CROSS-REFERENCE TO RELATED APPLICATIONS

This application claims priority to Italian Patent Application No. MI2006A001022, filed May 24, 2006.

BACKGROUND

1. Technical Field

The present invention generally relates to a gas operating system for firearms that allows firing of different cartridge loads for a given shell caliber or gauge.

2. Related Art

Automatic and semiautomatic shotguns having user-adjustable gas systems are known. Adjustable gas systems allow a user to control the amount of gas entering into and/or vented from the system, which allows a wider range of cartridge loads to be fired from a single firearm. However, if an adjustable gas system is set for heavy loads and the weapon is used to fire light loads, the firearm may not fully cycle, which may require the user to manually cycle the bolt in order to load the next round. If the adjustable gas system is set for light loads and the weapon is used to fire a heavy load, the bolt velocity after firing may result in improper cycling and the weapon may suffer reduced part life for certain components.

Firearms such as the Remington M/1187 have self-compensating gas systems. Self-compensating gas systems allow a wider range of loads to be fired without requiring adjustment of the gas system. However, the wide range of available cartridge loads may not be sufficiently compensated by conventional self-compensating systems. For example, 12 gauge loads have a wide spread from light 2¾" loads to heavy 3½" loads. As a result, some self-compensating designs may not reliably operate light loads under all conditions, and may suffer undesirably high bolt velocities when firing heavy magnum loads.

SUMMARY

According to a first example embodiment of the invention, a gas-operated firearm comprises a receiver, a firing mechanism, a barrel having a firing chamber, a plurality of ports extending through the barrel and opening into the firing chamber, a bolt having a locking position in which the bolt is adjacent a first, chamber end of the barrel, and a gas operating system comprising a gas cylinder. The gas cylinder has at least one piston bore in fluid communication with the barrel through the plurality of ports in the barrel. The bores in the barrel can be arranged as single ports or as groups of ports located at different distances from the chamber end of the barrel.

According to one aspect of the present invention, the firearm is capable of firing different cartridge loads, which generally correspond to different cartridge lengths. The ports in the barrel can be arranged so that when shorter, lighter load cartridges are fired, the cartridge casing is short enough so that it does not interfere with, or render "inactive" any of the ports in the barrel. The gases from firing therefore pass unimpeded to the gas operating system and provide the energy needed to perpetuate the action of the firearm. As longer cartridges corresponding to heavier loads are fired, the cartridge case may extend to a sufficient length within the chamber so that one or more of the ports in the barrel are at least partially blocked, obscured, or otherwise rendered "inactive" by the cartridge case. In general, the heavier the cartridge load, the longer the cartridge, and accordingly a greater number of ports are rendered inactive during firing of longer cartridges. The larger the number of inactive ports, the smaller the percentage of firing gases that are used to cycle the firearm. Heavier load cartridges are therefore compensated for because the greater the cartridge load, the smaller the percentage of the firing gases that is passed to the gas operating system to cycle the firearm.

According to another aspect of the invention, the firearm is capable of firing a wide range of shot loads without requiring active adjustment of the firearm. The gases transmitted for cycling the firearm are instead passively or automatically adjusted for according to the length of the shell casing.

According to yet another aspect of the invention, any number and/or combination of ports may be formed in the barrel, and corresponding ports formed in the gas cylinder, in order to accommodate firing of a wide variety of cartridge loads.

Other aspects, features, and details of embodiments of the present invention can be more completely understood by reference to the following detailed description of preferred embodiments, taken in conjunction with the drawings figures and from the appended claims.

According to common practice, the various features of the drawings discussed below are not necessarily drawn to scale. Dimensions of various features and elements in the drawings may be expanded or reduced to more clearly illustrate the embodiments of the invention.

BRIEF DESCRIPTION OF THE DRAWING FIGURES

DETAILED DESCRIPTION

The invention as exemplified by the embodiment discussed below is generally directed to a gas operating system for autoloading firearms. The gas operating system allows a user to fire different loads for a given shell caliber or gauge, while avoiding undesirably high bolt velocities caused by firing excessive loads, and also ensuring that the weapon cycles fully when firing lighter loads. The gas operating system controls the amount of gas tapped from the barrel used to operate the firearm action by controlling a number of "active" ports in the firing chamber. An "active" port may be generally defined as a gas bleed port that is at least partially unobstructed by a cartridge case and therefore available to tap gases generated during firing. According to the present invention, the gas ports may be located back in the chamber area of the barrel. Cartridge cases of differing sizes and loads selectively cover and render gas ports inactive according to the lengths of the cartridge cases.

Figure 1:
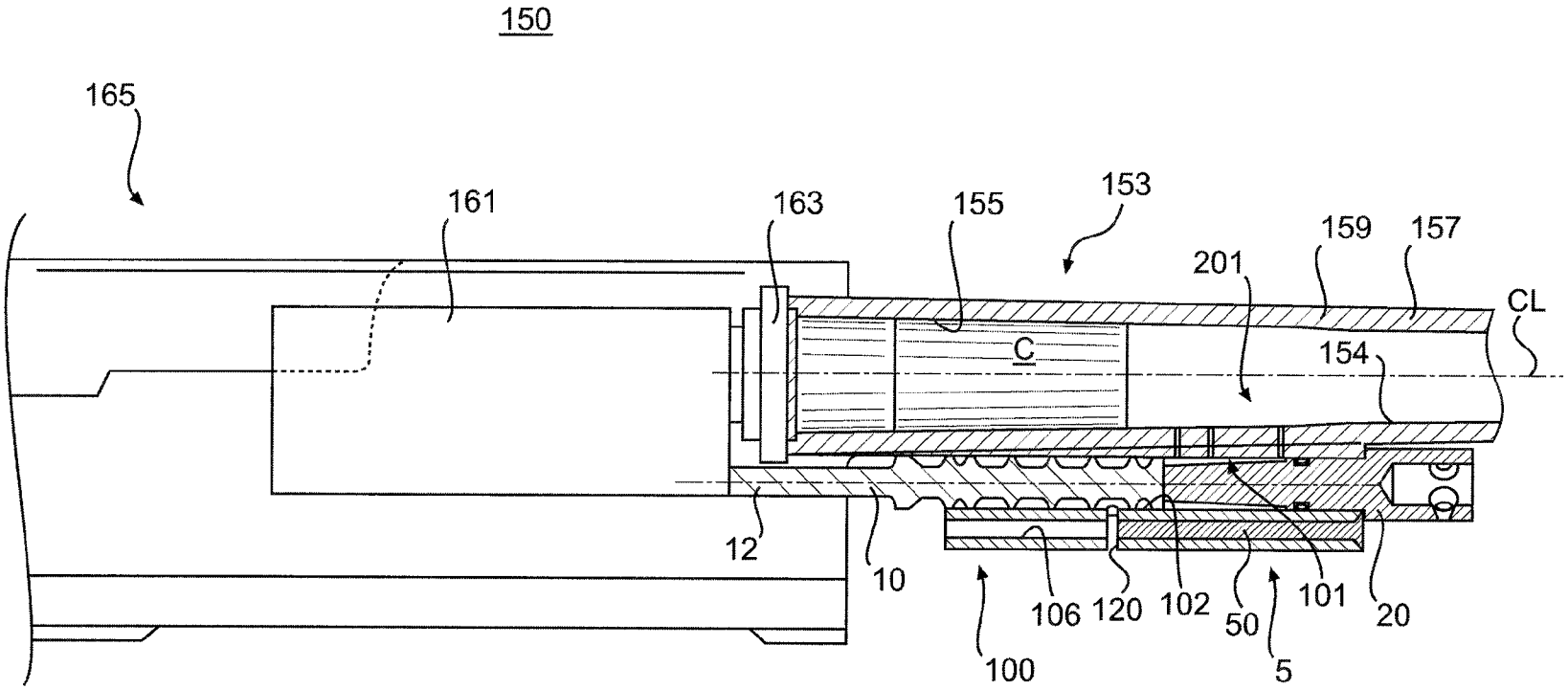
FIG. 1 is a partial sectional schematic view of a firearm having a gas operating system according to a first embodiment of the invention.

FIG. 1 is a partial sectional schematic view of a gas-operated smoothbore shotgun firearm 150 incorporating a gas operating system 5 according to the first embodiment of the invention. The gas-operated shotgun 150 includes a barrel 153 having a longitudinal bore 154 with a longitudinal axis or centerline CL. The barrel 153 includes a cartridge firing chamber 155 that is connected with a cylindrical portion 157 of the barrel 153 by a frustoconical constriction portion 159. The cylindrical portion 157 of the barrel 153 may extend to a muzzle end (not shown) of the barrel. An example cartridge C is chambered within the firing chamber 155. A bolt 161 is actuated by gas from a plurality of gas ports, collectively indicated by the reference numbers 101 and 201, in a manner described in further detail below. Each of the gas ports 101 of the gas operating system 5 is aligned with a corresponding one of the ports 201 in the barrel 153. The ports 101, 201 allow gases generated during firing to be tapped from the firing chamber 155 to cycle the firearm 150. In the exemplary illustrated embodiment, the bolt 161 has a rotating head 163 which may be, for example, of the type described in U.S. Pat. No. 4,604,942. Other bolt types may be used, and for the sake of brevity, the operation of the bolt 161 is not repeated herein in detail.

FIG. 1 is partially schematic in that several of the ports 101 and the corresponding ports 201 in the barrel 153 are visible in the section view of the cartridge firing chamber 155. As shown in further detail in FIGS. 4A-4E and discussed below, the ports 101 are offset at different radial and longitudinal positions in the gas operating system 5, and therefore all of the ports 101 would not be visible in a single planar section view. Each of the ports 201 in the firing chamber 155 is aligned with one of the ports 101, and multiple ports 201 also would not be visible in a single section view.

The gas operating system 5 includes a first and a second piston pusher rod 10 (only one piston pusher rod 10 is shown in FIG. 1), a first and a second gas diverter and cap 20 (only one is shown in FIG. 1), a first and a second gas stop 50 (only one is shown in FIG. 1), and a gas cylinder 100. The gas cylinder 100 may be attached to or formed as a part of the firearm barrel 153. In the exemplary embodiment shown in FIG. 1, the underside of the chamber 155 of the firearm 150 rests on an upper surface of the gas cylinder 100 and the gas cylinder 100 is brazed to the underside of the barrel 153. Each of the gas ports 101 formed in the gas cylinder 100 is aligned with and in fluid communication with one of the gas ports 201 in the barrel 153. The structure and operation of the gas system 5 is described in further detail below.

Figure 2:
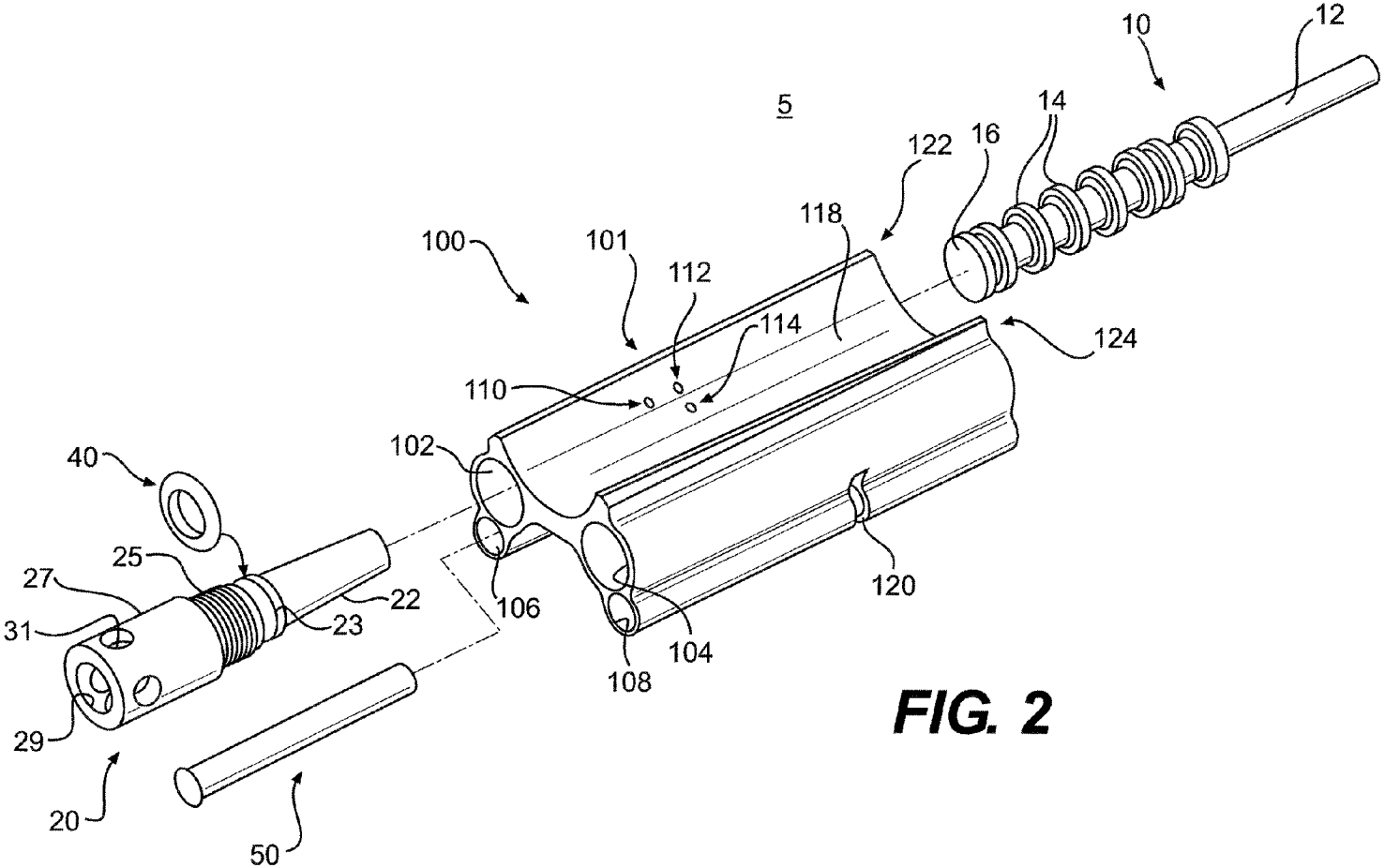
FIG. 2 is an exploded view of the gas operating system according to the first embodiment.

FIG. 2 is an exploded perspective view of the components of the gas operating system 5. The gas operating system 5 includes the first and second piston pusher rods 10 (only one piston pusher rod 10 is shown in FIG. 2), the first and a second gas diverters and caps 20 (only one is shown in FIG. 2), the first and second gas stops 50 (only one is shown in FIG. 2), and the gas cylinder 100. The gas cylinder 100 is generally divided into first and second longitudinally extending sections 122, 124. In the exemplary firearm embodiment shown in FIG. 1, the chamber 155 of the firearm 150 rests on a cylindrical concave upper profile 118 of the cylinder 100 that conforms to the shape of the underside of the barrel 153.

The piston pusher rods 10 each include an elongate cylindrical piston body 12 having a plurality of spaced annular cleaning ribs 14 and a head 16. The first piston pusher rod 10 is receivable and longitudinally translatable within a rear end of a first longitudinal piston bore 102 disposed in the first section 122 of the gas cylinder 100. The second piston pusher rod 10 (not shown) of similar or identical construction to the first pusher rod 10 is receivable and translatable within a rear end of a second longitudinal piston bore 104 disposed in the second section 124 of the gas cylinder 100.

The first gas diverter and cap 20 is receivable within a front end of the first longitudinal piston bore 102 and can be threadably engaged with the piston bore 102 at threads 25. A frustoconical stem 22 extends from one end of the diverter and cap 20, and is adjacent to an annular recess 23 that is sized to receive an O-ring 40. The O-ring 40 provides a gas seal for the cap and diverter 20 when mounted in the first piston bore 102. The cap 27 extends from a front end of the cap and diverter 20 and includes peripherally-spaced bores 31. The peripheral bores 31 can be provided, for example, to allow insertion of a tool used to screw and unscrew the diverter and cap 20 from the piston bore 102. A longitudinal lightening bore 29 may extend through the end of the cap and diverter 20. The second gas diverter and cap 20 (not shown) of similar or identical construction is receivable and threadably engageable within a front end of the second longitudinal lightening bore 104.

The first gas stop 50 is receivable within a front end of a first bleed bore 106 in the first longitudinal section 122 of the gas cylinder 100. A gas bleed slot 120 (see FIG. 1) is formed in a side of the first section 122 of the gas cylinder 100, and is in fluid communication with the first bleed bore 106. The first gas stop 50 extends from the front end of the first bleed bore 106 and terminates short of the gas bleed slot 120, as shown in FIG. 1. A second gas bleed slot 120 is formed in the second section 124 of the gas cylinder 100, and is in fluid communication with a second bleed bore 108 in the second section 122. The second gas stop 50 of similar or identical construction is received in the front end of the second bleed bore 108. The gas stops 50 may be freely translatable within their respective bores 106, 108, and are held in place by the cap and diverters 20 in the bores 102, 104 respectively.

According to one aspect of the invention, the plurality of gas ports 101 are formed in the gas cylinder 100, in fluid communication with the plurality of ports 201 in the barrel 153 (FIG. 1), and allow cartridge loads of different "strength" to be fired from the firearm 150. Three of the gas ports 101 are illustrated in FIG. 2, and are indicated by the reference numbers 110, 112, 114. Additional gas ports 130, 132, 134 of the plurality of ports 101 in the gas cylinder 100 are illustrated in FIGS. 3A-3C, and are discussed in detail below.

Figure 3A:
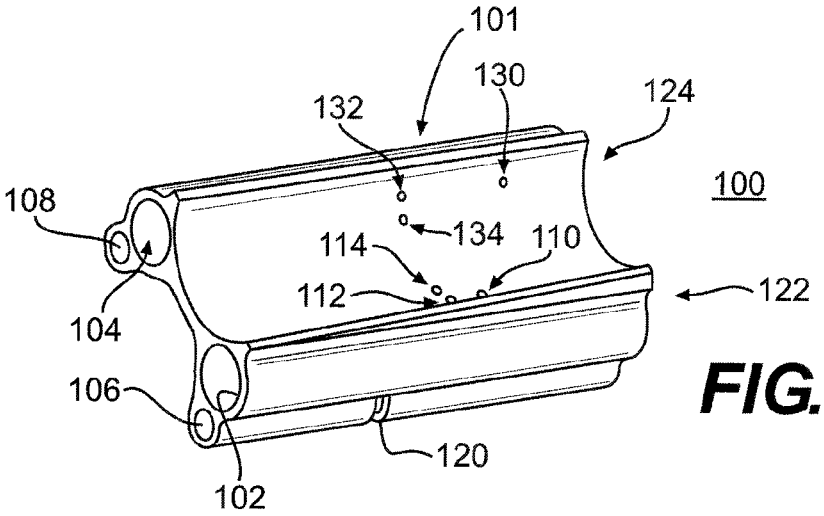
FIG. 3A is a perspective view of a gas cylinder of the gas operating system.

FIG. 3A is a perspective view of the upper surface of the gas cylinder 100 illustrating the arrangement of the gas ports 110, 112, 114, 130, 132, 134 in the gas cylinder. FIG. 3B is a side elevational view of the gas cylinder 100, and FIG. 3C is a top view of the gas cylinder. The gas ports 110, 112, 114, 130, 132, 134 are arranged along the length of the first and second sections 122, 124 of the gas cylinder 100, and generally extend through the cylinder from the upper surface to a lower surface of the gas cylinder 100. The upper ends of the gas ports 110, 112, 114, 130, 132, 134 are visible in FIGS. 3A and 3C.

Figure 3B:
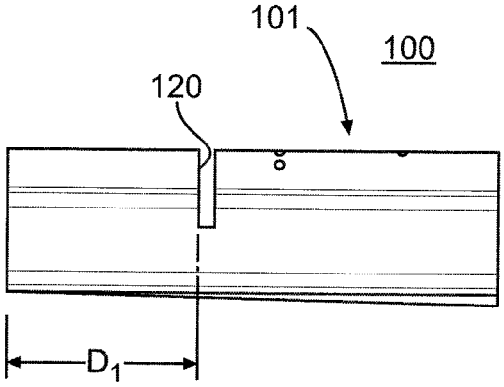
FIG. 3B is a side elevational view of the gas cylinder.
Figure 3C:
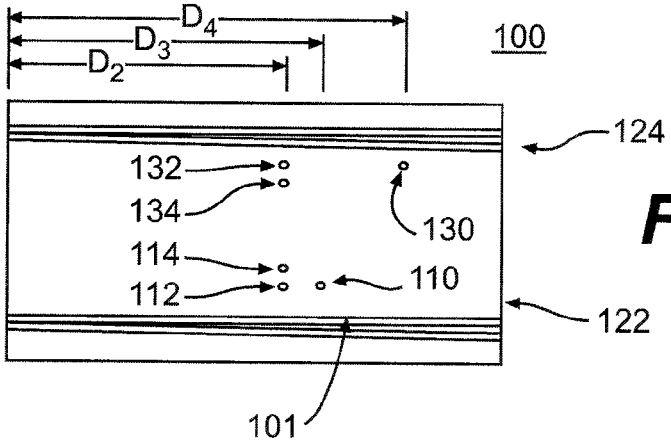
FIG. 3C is a top view of the gas cylinder.

Referring to FIG. 3B, the gas bleed slots 120 in the sections 122, 124 are spaced a distance $D_1$ from a rear end of the gas cylinder 100. Referring to FIG. 3C, the gas ports 110, 112, 114, 130, 132, 134 are staggered at three exemplary distances $D_2$, $D_3$, $D_4$ from the rear of the gas cylinder 100. The ports 112, 114, which are formed in the first section 122, and the ports 132, 134, formed in the second section 124, are disposed at the distance $D_2$ from the rear of the gas cylinder 100. The port 110 is formed in the first section 122 and is located at the distance $D_3$. The port 130 is formed in the second section 124 and is located at the distance $D_4$. Cartridge shells of different lengths may be selected to wholly or partially block, close off, or otherwise cover one or more of the staggered gas ports 110, 112, 114, 132, 134, thereby rendering the closed gas port "inactive." An inactive gas port is either wholly or partially ineffective in transmitting gases generated during firing to the longitudinal piston bores 102, 104, and therefore do not fully contribute to the rearward forces on the piston pusher rods 10 (illustrated in FIG. 2) that force the bolt rearwardly.

Figure 4:
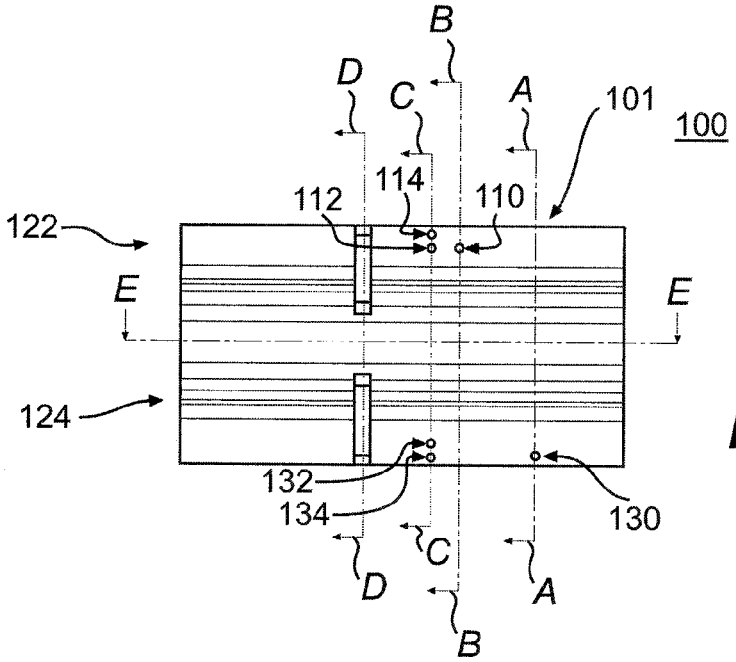
FIG. 4 is a bottom view of the gas cylinder.

FIG. 4 is a bottom view of the gas cylinder 100 and illustrates the bottom terminal ends of the gas ports 110, 112, 114, 130, 132, 134 in the gas cylinder. As shown in the sectional views 4A-4C, the ports 110, 112, 114, 130, 132, 134 may be formed in the gas cylinder 100 at various angular orientations.

Figure 4A:
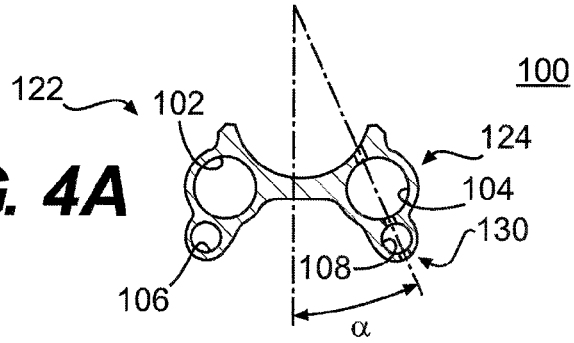
FIG. 4A is a section view taken on line A-A in FIG. 4.
Figure 4B:
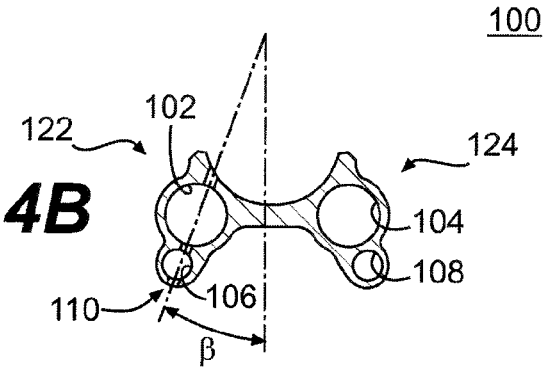
FIG. 4B is a section view taken on line B-B in FIG. 4.
Figure 4C:
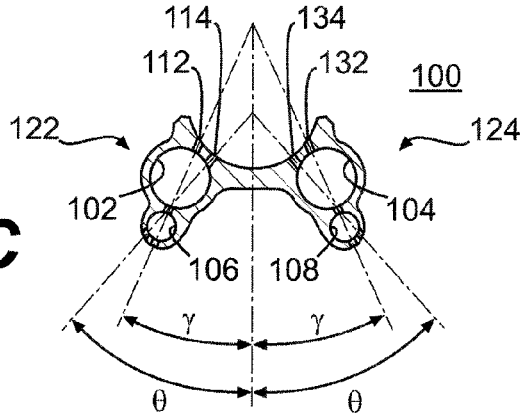
FIG. 4C is a section view taken on line C-C in FIG. 4.

FIG. 4A is a transverse section view taken on line A-A in FIG. 4 and illustrates the gas port 130 formed in the second section 124 and located at the distance $D_4$ from the rear end of the gas cylinder 100. The port 130 is oriented at an angle $\alpha$ with respect to a vertical reference line. FIG. 4B is a transverse section view taken on line B-B in FIG. 4 and illustrates the port 110 formed in the first section 122 at the distance $D_3$. The port 110 is oriented at an angle $\beta$ with respect to a vertical reference line. FIG. 4C is a transverse section view taken on line C-C in FIG. 4 and illustrates the ports 112, 114, 132, 134 formed at the distance $D_2$. The ports 112, 132 are oriented at an angle $\gamma$ in the respective sections 122, 124 with respect to a vertical reference line. The ports 114, 134 are oriented at an angle $\theta$ in the respective sections 122, 124 with respect to a vertical reference line.

Figure 4D:
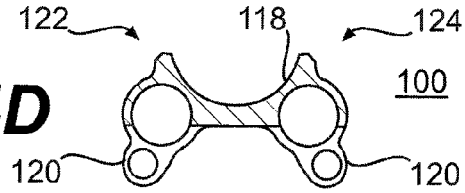
FIG. 4D is a section view taken on line D-D in FIG. 4.
Figure 4E:
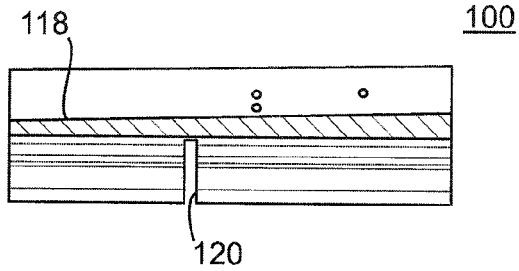
FIG. 4E is a section view taken on line E-E in FIG. 4.

FIG. 4D is a transverse section view of the gas cylinder 100 taken on line D-D in FIG. 4. FIG. 4E is a longitudinal section view of the gas cylinder 100 taken on line E-E in FIG. 4. FIGS. 4D and 4E illustrate the gas bleed slots 120 formed in the underside of the gas cylinder 100. The gas bleed slots 120 can be formed by, for example, milling the underside of the gas cylinder 100. Referring to FIG. 4D, the upper surface 118 of the gas cylinder 100 can be generally concave cylindrical.

Firing of different cartridges using the firearm 150 and the accompanying function of the gas operating system 5 is discussed below with reference to FIGS. 1 and 5A-7B. For simplicity of illustration, as in FIG. 1, FIGS. 5A-7B are partially schematic in that all of the ports 110, 112, 114, 130, 132, 134 in the gas cylinder 100 and the corresponding ports 201 in the barrel 153 are shown or indicated by a reference number in a single section view. As discussed above with reference to 3A-4C, the ports 110, 112, 114, 130, 132, 134 are located at different angular and longitudinal locations in the gas cylinder 100 and all would not be visible in a single longitudinal planar section view. In FIGS. 5A-7B, the ports 201 formed in the barrel 153 are numbered 210, 212, 214, 230, 232, 234 to correspond to the ports 110, 112, 114, 130, 132, 134, respectively, formed in the gas cylinder 100 with which they are aligned and in fluid communication.

Figure 5A:
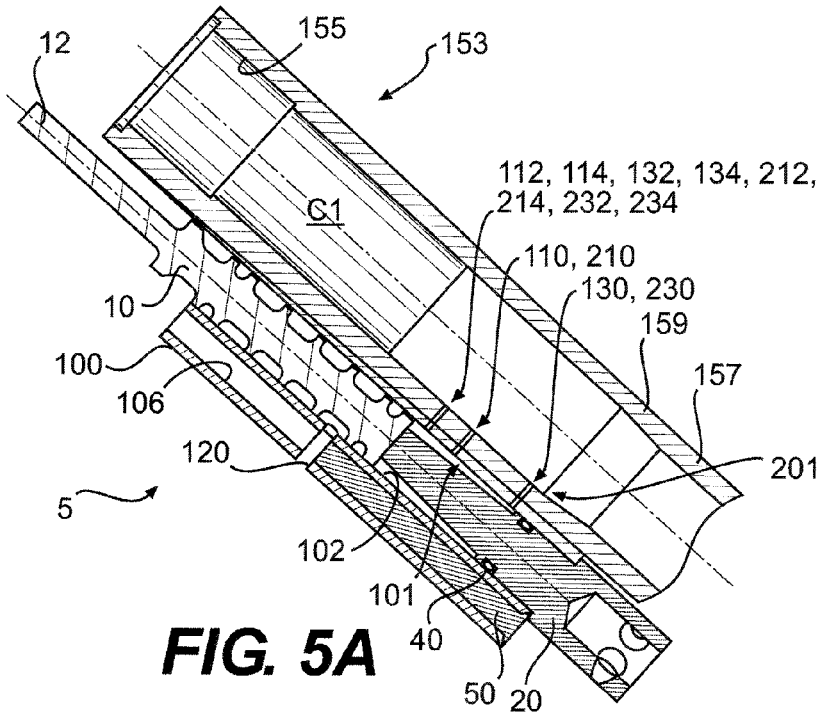
FIGS. 5A and 5B are section views illustrating operation of the gas operating system when firing a first cartridge type.
Figure 5B:
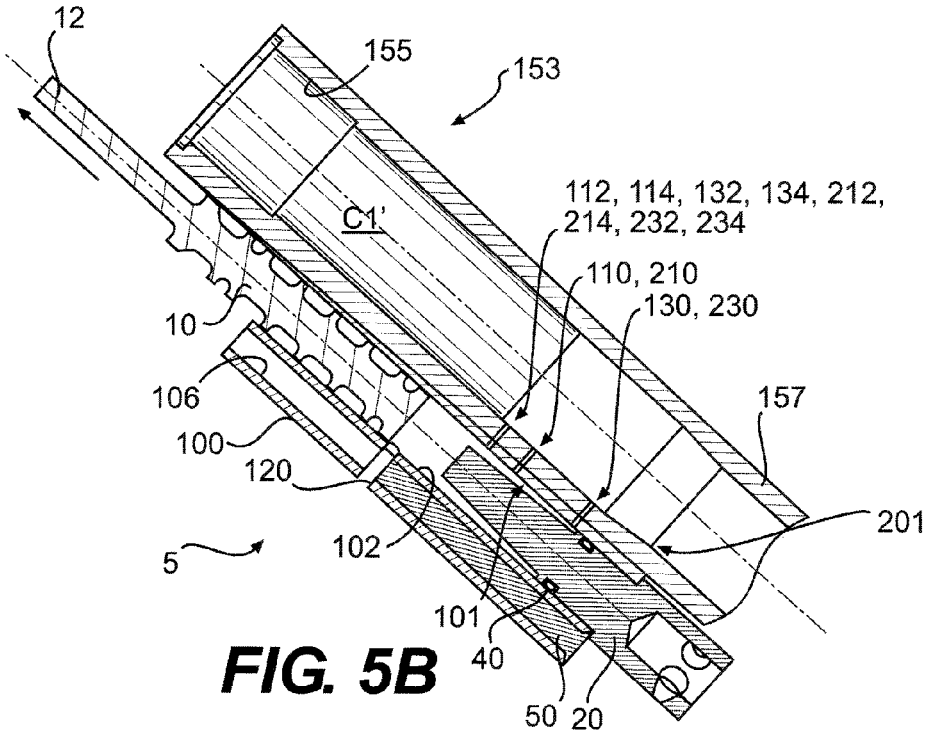

FIGS. 5A and 5B are sectional views illustrating operation of the gas operating system 5 with a first cartridge type C1. In this example, the cartridge C1 is relatively short in length, which generally corresponds to a lighter load shell. Because the cartridge C1 is of relatively light load, more of the gases generated during firing are allowed to pass to the gas cylinder 100 to perpetuate the action of the firearm 150.

Referring to FIGS. 1 and 5A, a shell C1 is loaded into the chamber 155 and the bolt 161 is closed, chambering the shell C1. The bolt head 163 locks to the barrel 153 or a barrel extension, if present. Locking the bolt head 163 secures the cartridge C1 in the firing chamber 155 after the shell C1 is fired. In the illustrated example, the bolt design is a rotating design, but other bolt types can be used. Generally speaking, the shell C1 is fired by activating a firing mechanism, such as by pulling a trigger to release a striker, which in turn hits the cartridge primer (not shown). The primer is ignited and in turn ignites the main powder charge in the shell C1. As pressure builds in the cartridge case and the chamber 155, the wad and shot column travels down the barrel 153.

As the shot column travels down the barrel 153, a percentage of the high pressure firing gases in the barrel 153 is tapped and is introduced into the gas cylinder 100. Referring to FIG. 5B, when the first cartridge type C1 is fired, the case of the cartridge C1 assumes the extended form C1' as the cartridge casing unrolls. In this example, the extended cartridge form C1' does not cover or otherwise at least partially obstruct any of the ports 210, 212, 214, 230, 232, 234 in the barrel 153. All ports 210, 212, 214, 230, 232, 234 therefore remain active to transmit gases through their corresponding ports 110, 112, 114, 130, 132, 134, respectively. Referring also to FIG. 1, gases transmitted through the ports 110, 112, 114 are transmitted into the first piston bore 102 and force the first pusher piston rod 10 rearwardly against the bolt 161 in the direction of the arrow. Gases transmitted through the ports 130, 132, 134 are transmitted to the second piston bore 104 (not shown in FIG. 5B) and force the second pusher piston rod 10 rearwardly against the bolt 161. The gases generated during firing are therefore fully transmitted through all of the ports 110, 112, 114, 130, 132, 134 (i.e., all ports are active) to the first and second piston pusher rods 10 in the bores 102, 104, which provides the energy to unlock the bolt 161 and to propel the bolt 161 rearwardly. As the pusher piston rods 10 move rearwardly and uncover the gas bleed slots 120, the firing gases vent through the bores 106, 108 and the slots 120.

As the bolt 161 travels rearwardly, the spent case C1 is pulled from the chamber 155 and ejected from the firearm 150. The bolt 161 travels to the rear of the receiver 165, which also compresses the action spring (not shown). If no feeding shell is present in a magazine, the bolt 161 locks open. If a feeding shell is present, the bolt 161 is released from the rear position and is propelled forward by the stored energy in the action spring. As the bolt 161 travels back toward the barrel 153, a new shell is fed into the chamber 155 and the bolt head 163 locks to the barrel 153. The cycle repeats when the trigger is again pulled.

Figure 6A:
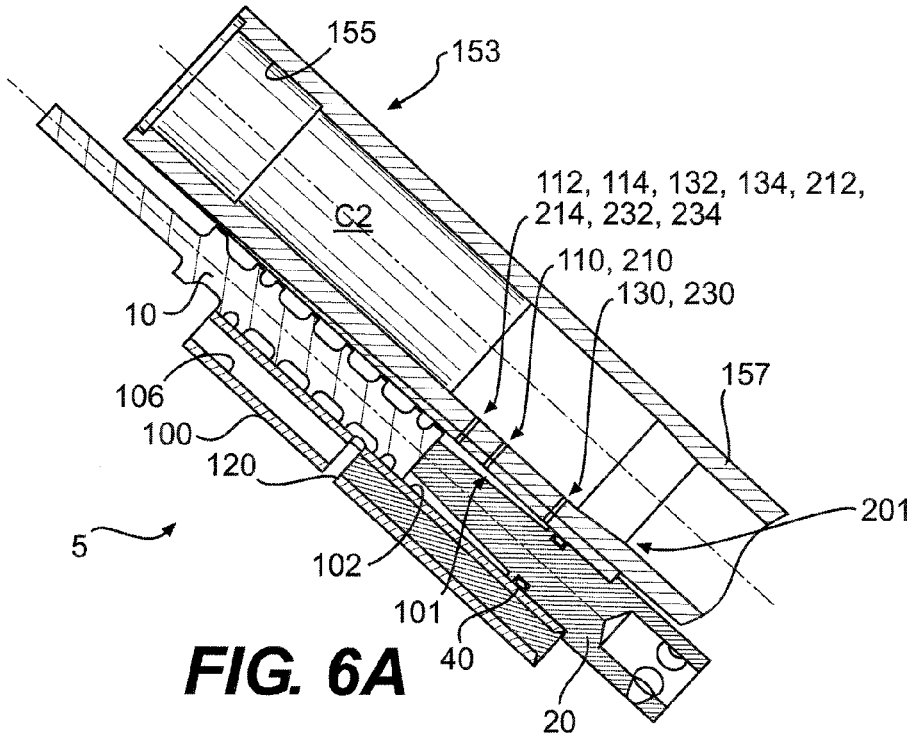
FIGS. 6A and 6B are section views illustrating operation of the gas operating system when firing a second cartridge type.
Figure 6B:
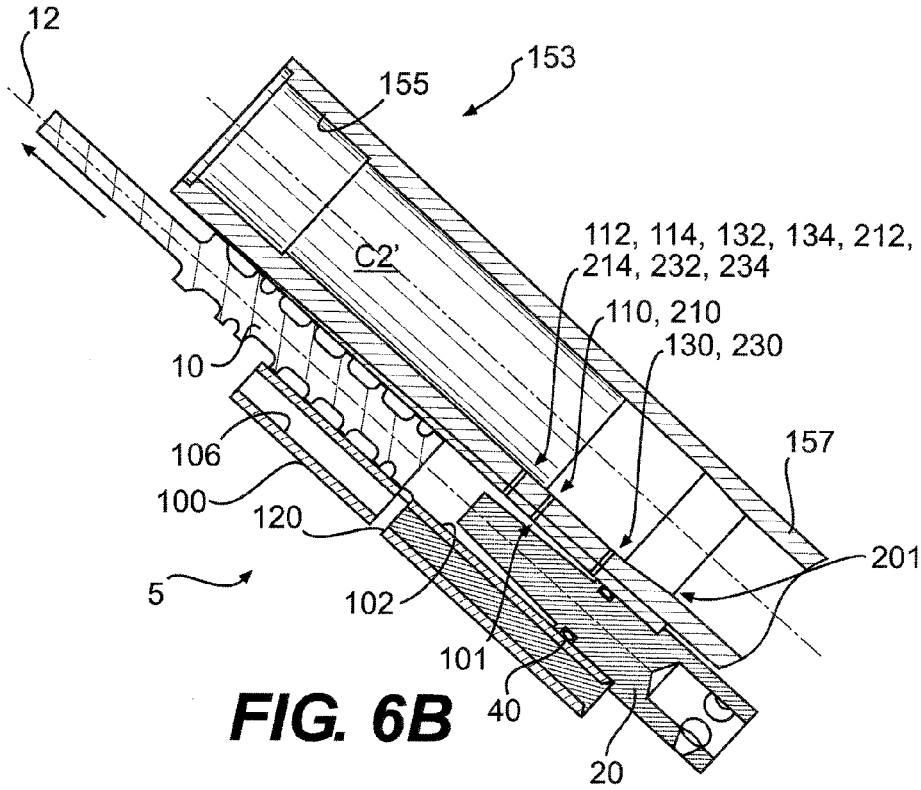

FIGS. 6A and 6B are sectional views illustrating operation of the gas operating system 5 with a second cartridge type C2. In this example, the second cartridge type C2 is longer than the first cartridge C1, which generally corresponds to a heavier load shell. Because the cartridge C2 is of heavier load, a smaller portion of the gases generated during firing are communicated to the gas cylinder 100 to perpetuate the action of the firearm 150.

The cartridge C2 is fired in generally the same manner as the cartridge C1. Referring to FIG. 6B, as the cartridge C2 is fired, the case of the cartridge C2 extends as it unrolls and assumes the form C2'. The extended case C2' at least partially covers the ports 212, 214, 232, 234 in the barrel 153, rendering them inactive. The gases generated during firing are therefore either wholly or partially blocked from passing into the gas cylinder 100 through the corresponding ports 112, 114, 132, 134 in the gas cylinder 100 with which the ports 212, 214, 232, 234 are in fluid communication. The other ports 210, 230 in the barrel 153 remain active, and the firing gases are allowed to pass through the corresponding ports 110, 130 and into the first and second piston bores 102, 104, respectively. The gases transmitted to the first and second piston bores 102, 104 provide the energy required to force the pusher piston rods 10 rearwardly to cycle the firearm 150, as discussed above.

Figure 7A:
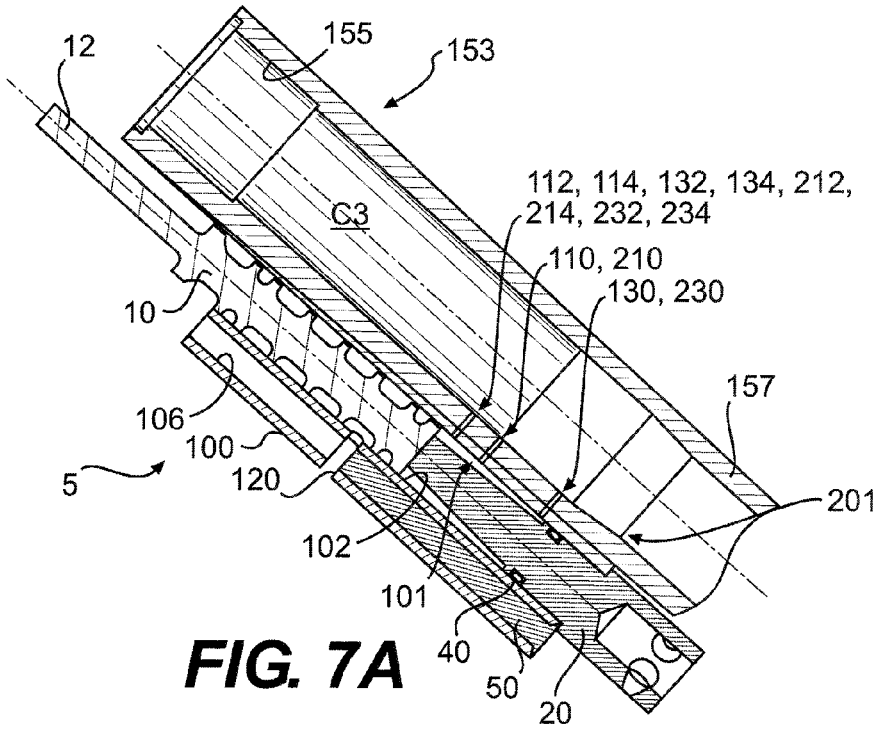
FIGS. 7A and 7B are section views illustrating operation of the gas operating system when firing a third cartridge type.
Figure 7B:
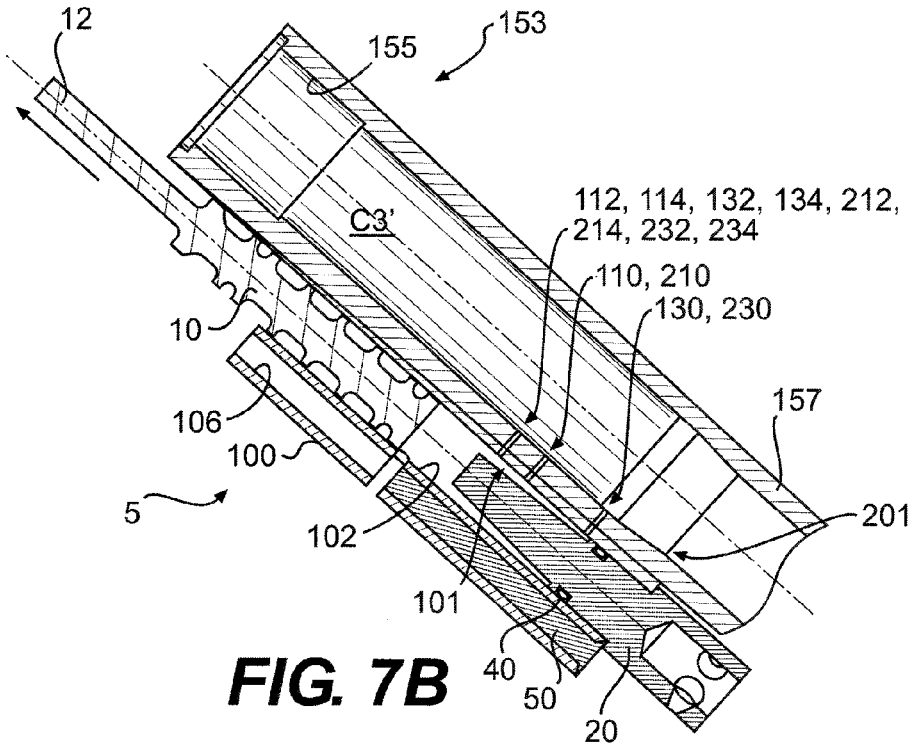

FIGS. 7A and 7B are sectional views illustrating operation of the gas operating system 5 with a third cartridge type C3. In this example, the third cartridge C3 is longer than the second cartridge C2, which generally corresponds to a heavy load shell. Because the cartridge C3 is of heavy load, a relatively small portion of the high pressure gases generated during firing are communicated to the gas cylinder 100 to perpetuate the action of the firearm 150.

The third cartridge type C3 is fired in generally the same manner as the cartridges C1 and C2 discussed above. Referring to FIG. 7B, as the cartridge C3 is fired, the case of the cartridge C3 extends as it unrolls and assumes the form C3'. The extended case C3' at least partially covers or otherwise obstructs the ports 212, 214, 232, 234, 210 in the barrel 153, rendering them inactive. The gases generated during firing are therefore either wholly or partially blocked from passing into the gas cylinder 100 through the corresponding ports 112, 114, 132, 134, 110 in the gas cylinder 100 with which the ports 212, 214, 232, 234, 210 are in fluid communication. Only the port 230 remains active, and gases are transmitted through the corresponding port 130 in the gas cylinder 100 and into the second piston bore 104. The gases transmitted to the second piston bore 104 act on the second pusher piston rod 10 to cycle the firearm 150 as discussed above. In this mode of operation, only one pusher piston rod 10 is used to cycle the firearm 150.

According to one aspect of the present invention, the gas operating system renders a firearm capable of firing a wide range of shot loads without requiring active adjustment of the firearm. The gases transmitted for cycling the firearm are instead passively or automatically adjusted for according to the length of the shell casing. Any number and/or combination of ports may be formed in the barrel, and corresponding ports formed in the gas cylinder, in order to accommodate firing of a wide variety of cartridge loads.

Example

A firearm 150 is provided with a gas operating system 5 as illustrated in FIGS. 1-7B. The gas cylinder 100 has a length, measured from left to right in FIG. 4, of 77 mm. The distances illustrated in FIGS. 3B and 3C are: $D_1$=30.2 mm, $D_2$=43 mm, $D_3$=49 mm, and $D_4$=62 mm. The angles illustrated in FIGS. 4A-4C are: $\alpha$=25°$\beta$=25°, $\gamma$=25°, and $\theta$=42°. Each of the ports 110, 112, 114, 130, 132, 134 are cylindrical bores having a diameter of 1.2 mm. The ports 210, 212, 214, 230, 232, 234 are also cylindrical bores. The piston bores 102, 104 are cylindrical bores having a diameter of 10.8 mm. The bleed bores 106, 108 are cylindrical bores having a diameter of 5 mm. The exemplary cartridge C1 illustrated in FIGS. 5A and 5B corresponds to 2¾ inch 12 gauge ammunition. The exemplary cartridge C2 illustrated in FIGS. 6A and 6B corresponds to 3 inch 12 gauge ammunition. The exemplary cartridge C3 illustrated in FIGS. 7A and 7B corresponds to 3½ inch 12 gauge ammunition.

In the embodiment described above, the barrel 153 is illustrated as formed separately from the gas cylinder 100, and gases generated during firing are communicated from the chamber 155 through aligned sets of ports in the barrel 153 and the gas cylinder 100. In an alternative embodiment, the gas cylinder and the barrel may be of a one-piece construction, requiring only one set of ports.

The gas cylinder 100 described above is divided into two sections 122, 124, which house two separate piston pusher rods 10 in a "dual-tap" configuration. A "single-tap" system, using a single piston bore with a single piston pusher rod, is also within the scope of the present invention. In this embodiment, bores formed in the firearm barrel would each be in fluid communication with the single piston bore.

The components of the gas operating system 5 can be made from conventional durable, high strength materials including metals, such as hardened steel, composites, and other materials.

In the illustrated embodiment, the ports 110, 112, 114, 130, 132, 134 in the gas cylinder 100 and the corresponding port 210, 212, 214, 230, 232, 234 in the barrel 153 are straight along their lengths and circular in cross section. The ports may, however, take the form of other apertures, such as, for example, apertures of non-circular cross section.

The ports 110, 112, 114, 130, 132, 134 in the gas cylinder 100 and the corresponding ports 210, 212, 214, 230, 232, 234 in the barrel 153 can be formed by methods such as drilling, for example. In one exemplary method of manufacture, the gas cylinder can be brazed to the barrel before forming the gas tap ports. Each port in the gas cylinder (e.g. port 110) and its corresponding port in the barrel (e.g. port 210) can then be drilled in a single drilling operation. In order to facilitate drilling, slots or other locating features may be milled or otherwise formed at one or more locations on the underside of the gas cylinder so that a drill bit can be readily located on the exterior of the gas cylinder. When viewed from the perspective of FIG. 1, the ports 110, 112, 114, 130, 132, 134 in the gas cylinder 100 and the corresponding ports 210, 212, 214, 230, 232, 234 in the barrel 153 are illustrated as extending perpendicular or substantially perpendicular to the long axis CL of the barrel 153. The ports may, however, be oriented at other nonzero angles with respect to the long axis CL of the barrel.

The example embodiment of the gas operating system 5 is incorporated in a gas-actuated twelve-gauge shotgun. Other types of gas-actuated firearms may be equipped with a gas operating system as discussed herein without departing from the scope of the present invention.

The gas ports disclosed in this specification are described as formed by drilling. Any of the ports in this specification can be formed by alternative methods, such as, for example, electronic discharge machining (EDM).

The method of operating the firearm 150 is described in terms of a trigger-operated firing mechanism that releases a striker. Other types of firing mechanisms, such as, for example, electrical firing mechanisms, can also be incorporated in a firearm in accordance with the present invention.

The foregoing description of the invention illustrates and describes the present invention. Additionally, the disclosure shows and describes only selected embodiments of the invention, but it is to be understood that the invention is capable of use in various other combinations, modifications, and environments and is capable of changes or modifications within the scope of the inventive concept as expressed herein, commensurate with the above teachings, and/or within the skill or knowledge of the relevant art.

What is claimed is:

1. A firearm, comprising:

a receiver;

a firing mechanism;

a barrel having a firing chamber;

three or more ports extending through the barrel and opening into the firing chamber;

a bolt having a locking position in which the bolt is adjacent to a first end of the barrel; and a gas operating system, wherein the gas operating system comprises a gas cylinder having at least one piston bore in fluid communication with the barrel through at least one of three or more ports in the barrel;

wherein three or more ports in the barrel are arranged at varying locations along the length of the barrel from the firing chamber such that cartridges of different lengths can at least partially obscure one or more of the ports to vary flows of gases transmitted to the gas cylinder of the gas operating system.

2. The firearm of claim 1, wherein at least a first port of the three or more ports is at a first distance from the first end of the barrel, and at least a second port of the three or more ports is at a second distance from the first end of the barrel that is greater that the first distance.

3. The firearm of claim 2, wherein at least a third port of the three or more ports is at a third distance from the first end of the barrel that is greater than the second distance.

4. The firearm of claim 1, wherein the at least one piston bore comprises a first piston bore and a second piston bore.

5. The firearm of claim 1, wherein the barrel comprises a frustoconical constriction between the plurality of ports and a second end of the barrel.

6. The firearm of claim 1, wherein the gas operating system further comprises at least one pusher piston rod axially translatable within the at least one piston bore.

7. The firearm of claim 1, wherein the gas cylinder is joined to an underside of the barrel, and wherein the gas cylinder comprises three or more ports, one each of the ports in the gas cylinder being aligned with a corresponding one of the ports in the barrel.

8. The firearm of claim 1, wherein the ports in the barrel extend through the barrel at a nonzero angle with respect to a longitudinal axis of the barrel.

9. A firearm, comprising:

a receiver;

a firing mechanism;

a barrel having a firing chamber at a first end of the barrel;

three or more ports extending through the barrel;

a gas operating system comprising a gas cylinder in communication with the barrel through the three or more ports in the barrel, wherein at least a first port of the plurality of ports is located along the barrel at a first distance from the first end of the barrel, and at least a second port of the plurality of ports is located along the barrel at a second distance from the first end of the barrel, wherein the second distance is greater than the first distance wherein cartridges of different lengths can at least partially obscure one or more of the ports to vary flows of gases transmitted to the gas cylinder of the gas operating system.

10. The firearm of claim 9, wherein at least a third port of the plurality of ports is at a third distance from the first end of the barrel that is greater than the second distance.

11. The firearm of claim 9 wherein the gas cylinder comprises a first piston bore and a second piston bore.

12. The firearm of claim 11, wherein the gas operating system further comprises a first pusher piston axially translatable within the first piston bore.

13. The firearm of claim 9, wherein the barrel comprises a frustoconical constriction between the three or more ports and a second end of the barrel.

14. The firearm of claim 9, wherein the gas cylinder is joined to an underside of the barrel, and wherein the gas cylinder comprises three or more ports, one each of the ports in the gas cylinder being aligned with a corresponding one of the ports in the barrel.

15. The firearm of claim 9, wherein the ports in the barrel extend through the barrel at a nonzero angle with respect to a longitudinal axis of the barrel.

16. A method of operating a firearm, comprising:

loading a firearm comprising: a receiver; a firing mechanism; a barrel having a firing chamber; three or more ports extending through the barrel and opening into the firing chamber;

and a gas operating system, with a cartridge, the cartridge having a case of a predetermined length;

chambering the cartridge in the firing chamber;

actuating the firing mechanism to fire the cartridge, wherein as the cartridge is fired, the case extends axially in the firing chamber, and at least partially covers at least one of the three or more ports so as to at least partially prevent a portion of gases generated from firing to pass through the at least one of the three or more ports in the barrel to control operation of the gas operating system of the firearm.

17. The method of claim 16, wherein the ports in the barrel extend through the barrel at a nonzero angle with respect to a longitudinal axis of the barrel.

18. A method of operating a firearm, comprising:

loading a cartridge having a case within a firearm comprising: a receiver; a firing mechanism; a barrel having a firing chamber at a first end of the barrel; a plurality of ports extending through the barrel, the plurality of ports comprising a first port at a first distance from the first end of the barrel, a second port at a second distance from the first end of the barrel that is greater than the first distance, and a third port at a third distance from the first end of the barrel that is greater than the second distance;

chambering the cartridge in the firing chamber;

actuating the firing mechanism to fire the cartridge, wherein as the cartridge is fired, the case extends axially along the firing chamber, and at least partially prevents part of the gases generated from firing from passing through at least one of the plurality of ports.

19. The method of claim 18, wherein as the case extends axially the case at least partially prevents part of the gases generated from firing to pass through the second port.

20. The method of claim 18, wherein the ports in the barrel extend through the barrel at a nonzero angle with respect to a longitudinal axis of the barrel.

21. A method of manufacturing a barrel component for a firearm, comprising:

providing a barrel having a firing chamber, a muzzle end, a cylindrical portion, and a constriction between the firing chamber and the cylindrical portion;

providing a gas cylinder;

securing the gas cylinder to the barrel; and forming three or more spaced apertures through the gas cylinder and the barrel at spaced locations therealong, with the apertures located along the barrel at different distances from the firing chamber of the barrel so as to be selectively closeable by a cartridge received within the firing chamber, and wherein a first end of each aperture opens into the firing chamber.

22. The method of claim 21, wherein the aperture is oriented at a nonzero angle with respect to a longitudinal axis of the barrel.

* * * * *